United States Patent [19]

Bunting et al.

[11] 4,245,961

[45] Jan. 20, 1981

[54] EJECTOR UTILIZING A VORTEX FLOW

[75] Inventors: Jackie O. Bunting, Littleton; Wayne E. Simon, Evergreen, both of Colo.

[73] Assignee: Martin Marietta Corporation, Bethesda, Md.

[21] Appl. No.: 940,588

[22] Filed: Sep. 8, 1978

[51] Int. Cl.[3] ..... F04F 5/42

[52] U.S. Cl. ..... 417/171; 417/179; 417/182; 417/196

[58] Field of Search ..... 417/76, 84, 158, 171, 417/151, 167, 182, 190, 194, 196, 197, 198, 179; 60/269; 239/403, 405, 406

[56] References Cited

U.S. PATENT DOCUMENTS

| | | | |
|---|---|---|---|
| 584,951 | 6/1897 | More, Jr. | 239/405 |
| 1,950,828 | 3/1934 | Thompson | 417/171 X |
| 2,135,962 | 11/1938 | Conery et al. | 417/76 X |
| 2,512,456 | 6/1950 | Boyd et al. | 239/428 X |
| 2,565,907 | 8/1951 | Bertin et al. | 417/171 |
| 3,063,223 | 11/1962 | Arbisi | 417/171 X |
| 3,099,965 | 8/1963 | Regenscheit | 417/171 X |
| 3,306,525 | 2/1967 | Dornier | 417/171 |
| 3,648,457 | 3/1972 | Bobo | 60/39.74 R |
| 3,667,221 | 6/1972 | Taylor | 60/39.74 R |
| 3,739,576 | 6/1973 | Chamberlain | 60/39.74 R |

FOREIGN PATENT DOCUMENTS

| | | | |
|---|---|---|---|
| 115862 | 5/1918 | United Kingdom | 417/171 |
| 500690 | 2/1939 | United Kingdom | 239/406 |

*Primary Examiner*—Carlton R. Croyle
*Assistant Examiner*—Edward Look

[57] ABSTRACT

An improved ejector utilizing a vortex flow for pumping a fluid. The ejector includes a funnel shaped fluid chamber circumscribing a longitudinal axis and converging from a wide end to a narrow end. A venturi-like throat circumscribing the longitudinal axis is in fluid communication with the narrow end of the funnel shaped chamber. A pair of diametrically opposed fluid inlets are disposed in the wide end of the chamber for directing a driver fluid tangentially into the wide end of the funnel shaped chamber. The chamber and throat are configured to form the driver fluid into a swirling flow which advances toward the throat in the form of a vortex flow having a low pressure region. A secondary fluid inlet is in fluid communication with the low pressure region of the vortex flow. A deflector member is disposed in the funnel shaped chamber radially inward of the venturi throat. The deflector includes a surface which diverges away from the longitudinal axis. The vortex flow draws the fluid through the secondary fluid inlet and the deflector guides the fluid radially outwardly toward the throat as the fluid is drawn into the chamber, whereby the fluid is mixed with the driver fluid to form a swirling flow of mixed fluid which advances through the venturi-like throat and into a diffuser as a swirling flow. The diffuser guides the swirling flow of mixed fluids from the throat along a path of increasing radius to compress the mixed fluids to ambient pressure at the diffuser outlet and blocking flow of fluid at ambient pressure through the diffuser to the throat.

5 Claims, 3 Drawing Figures

EJECTOR UTILIZING A VORTEX FLOW

The present invention was supported under subcontract in connection with Government Contract No. C-09594DJCS.

BACKGROUND AND SUMMARY OF THE INVENTION

This invention relates to an improved construction of an ejector utilizing a vortex flow for pumping fluids. The ejector of the invention is particularly suitable for pumping fluids at extremely low pressures to ambient pressure.

U.S. patent application Ser. No. 898,961 (a continuation of Ser. No. 653,931) discloses a method and apparatus for pumping a fluid. The apparatus includes a fluid vortex forming chamber having a funnel shaped surface circumscribing a longitudinal axis and converging toward the longitudinal axis from a wide end to a narrow end. The narrow end of the funnel shaped surface communicates with a venturi-like throat which also circumscribes the longitudinal axis.

A driver fluid is introduced tangentially into the wide end of the chamber through a single inlet. The funnel shaped surface and venturi throat are designed to guide the driver fluid toward the throat in the form of a vortex flow having a low pressure region at the eye thereof. A low pressure fluid inlet communicates with the low pressure region of the vortex flow so that the vortex flow draws the low pressure fluid through the inlet and mixes the low pressure fluid with the driver fluid to form a swirling flow of mixed fluid which advances through the venturi-like throat.

The swirling fluid flow which exists the venturi throat swirls into a diffuser formed by spaced apart diverging surfaces which form a conical surface of increasing radius. The diffuser guides the swirling flow along a path of increasing radius to compress the mixed fluids to the ambient pressure at the diffuser outlet while blocking flow of fluid at the ambient pressure of the diffuser outlet to the throat.

As brought in the aforesaid specification the apparatus disclosed therein is capable of forming the driver fluid into a vortex flow which generates extremely low pressures at the eye thereof. Specifically, the apparatus has been found to generate pressures on the order of 100 torr (atmospheric pressure being on the order of 760 torr) at the eye of the vortex.

The present invention provides an ejector which improves the pumping action of an ejector such as disclosed in U.S. patent application Ser. No. 898,961. Specifically, the present invention provides an ejector which is capable of generating pressures at the vortex eye as low as 15 torr using an incompressible driver fluid (such as water, and pressures as low as 21 torr using a compressible driver fluid such as nitrogen. An ejector constructed according to the invention and using nitrogen as a driver fluid is particularly suitable for pumping neon lazer exhaust which is of extremely low pressures.

According to the present invention the driver fluid is introduce tangentially into the wide end of the vortex chamber through a pair of diametrically opposed fluid inlets. With a single inlet, such as disclosed in application Ser. No. 898,961, a separation bubble may eventally form along radially innermost surface of the diffuser member. Unless the diffuser member is skewed slightly with respect to the longitudinal axis, the separation bubble may propagate out to the diffuser outlet, where fluid at the ambient pressure of the diffuser outlet will be drawn into the vortex forming chamber. This would ultimately destroy the low pressure pumping capability of the device. The diametrically opposed driver fluid inlets of the present invention eliminates the possibility of a separation bubble forming along the conical diffuser and propagating outwardly along the diffuser to the outlet, without skewing part of the diffuser relative to the longitudinal axis.

Further according to the invention, a deflector member is provided in the vortex forming chamber. The deflector is disposed along the longitudinal axis and is further disposed radially inward of the venturi throat. The deflector includes a surface diverging away from the longitudinal axis and generally outwardly toward the venturi throat. The diverging surface guides the secondary fluid along a path of increasing radius in the vortex section and increases the mixing of the primary and secondary fluids. This has been found to further improve the pumping efficiency of an ejector utilizing a vortex flow.

Still further according to a particular aspect of the invention, a special vortex forming chamber is provided for pumping low pressure fluids with a compressible driver fluid such as nitrogen. The vortex forming chamber includes a conical surface converging inwardly from the wide end of the chamber to the mouth of the secondary fluid inlet. A pair of guide walls are further provided to guide flow from each driver fluid inlet along the conical surface and forwardly and radially inwardly of the diametrically opposite driver fluid inlet. This construction reduces viscous losses with a compressible driver fluid, and thereby further improves pumping action.

An tornado ejector constructed according to the present invention is also extremely compact in an axial direction and this makes it very advantageous from a size point of view.

BRIEF DESCRIPTION OF THE DRAWINGS

Further features and advantages of the invention will become apparent from the following detailed description taken with reference to the accompanying drawings wherein.

DETAILED DESCRIPTION OF THE PREFERRED EMBODIMENT

Figures 1, 3:
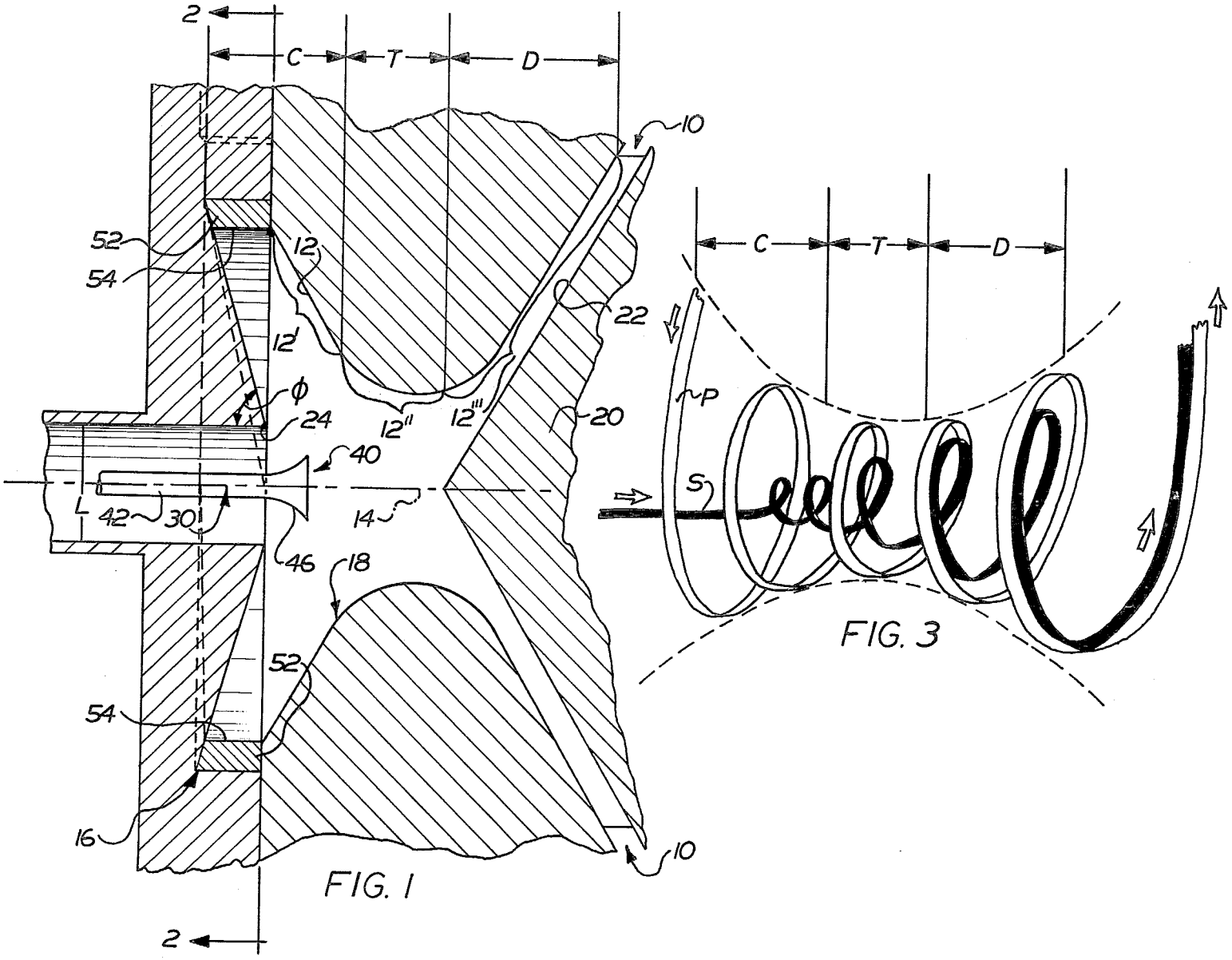
FIG. 1 is a longitudinal sectional view of an ejector constructed according to the principles of the invention taken from the direction 1—1 of FIG. 2.
FIG. 3 illustrates schematically the manner in which low pressure fluid is pumped in accordance with the principles of the invention.

Referring to FIG. 1, the ejector of the present invention is formed essentially by a vortex forming chamber C which is funnel shaped, a venturi-like throat T, and a diffuser D having an outlet 10 at an ambient pressure.

The vortex forming chamber is funnel shaped and converges from a wide end 16 to a narrow end 18. The chamber C includes a surface 12 having a funnel shaped portion 12' circumscribing a longitudinal axis 14. The surface 12 also includes a portion 12" which forms the venturi-like throat T communicating with the narrow end 18 of the vortex forming chamber.

The diffuser D is formed by a portion 12″ of surface 12 which diverges outwardly from the longitudinal axis 14 and a diffuser member 20 positioned along the longitudinal axis. The diffuser member 20 includes a diverging conical surface 22 disposed in facing relationship with the diverging surface 12″ to form a conically shaped section for guiding a swirling flow of fluid from the throat T along a path of increasing radius to compress the swirling flow to the ambient pressure at the diffuser outlet while blocking flow of ambient pressure from the diffuser outlet 10 to the throat.

Figure 2:
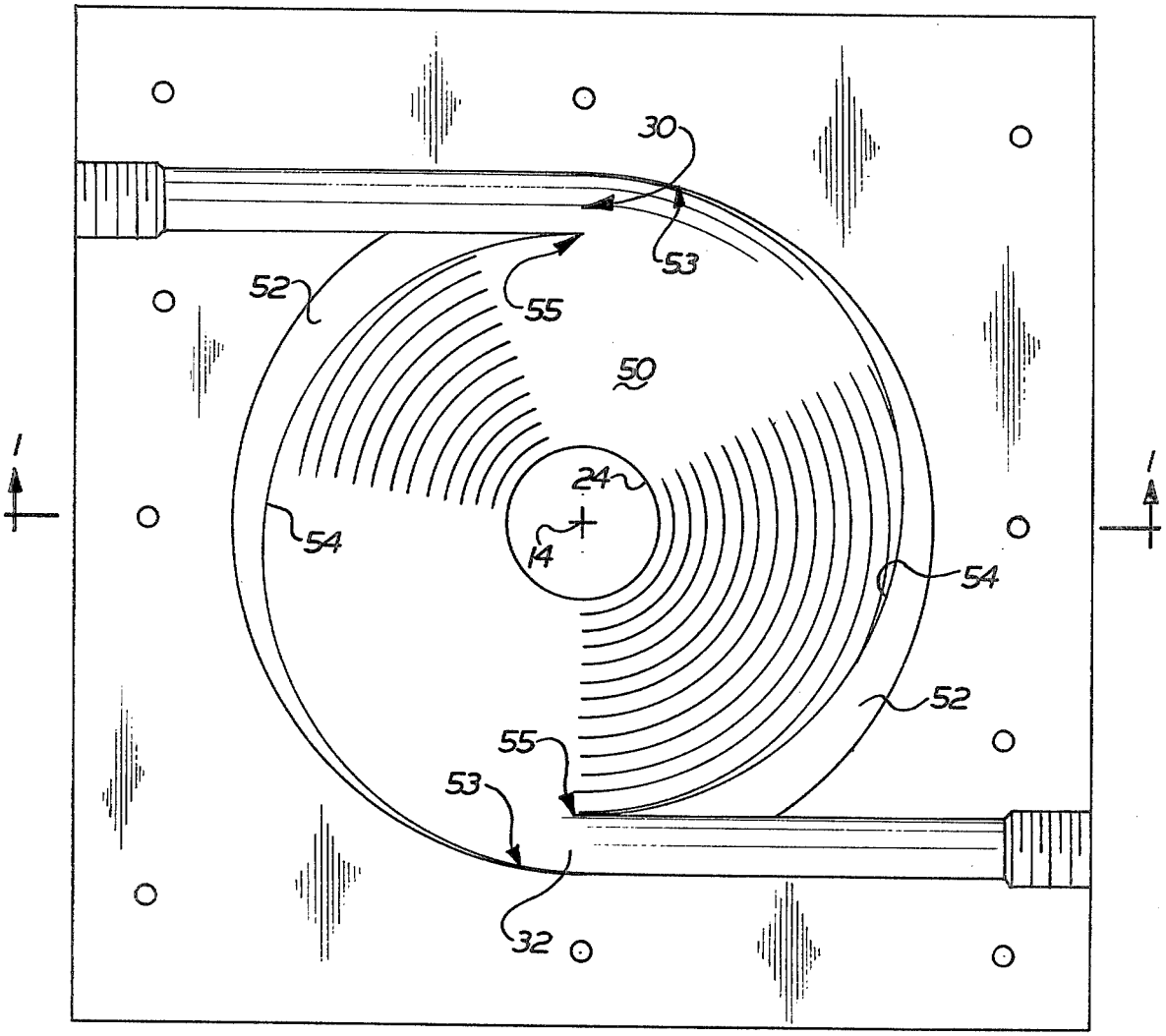
FIG. 2 is a sectional view of the ejector of FIG. 1 taken along the line 2—2 of FIG. 1 with portions omitted.

As seen in FIGS. 1 and 2 a secondary fluid inlet 24 communicating with the low pressure secondary fluid circumscribes the longitudinal axis 14. The secondary fluid inlet 24 is disposed in communication with the low pressure region formed by the primary driver fluid in the vortex forming chamber C.

As seen in FIG. 3 according to the basic principles of the ejector a flow of a primary driver fluid P directed tangentially into the wide end of the funnel shaped vortex forming section C spirals downwardly toward the venturi throat T along a path of decreasing radius and forms an intensely rotating vortex flow at the throat. This produces a vortex flow having a low pressure region at the eye thereof. The fluid enters the diffuser D as a swirling flow.

The secondary fluid S is drawn into the low pressure region of the vortex by the extremely low pressure of the vortex and is energized by the intensely rotating primary fluid P. The secondary fluid S spirals outwardly to mix with the primary driver fluid. Such mixing is caused at least in part by the intense rotational movement of the driver fluid. The mixed fluids thus sprial together into the diffuser section and compress to ambient pressure while blocking flow of ambient pressure from the diffuser outlet to the vortex. When the secondary fluid is at a very low pressure relative to ambient, this results in effective pumping of the low pressure secondary fluid to ambient pressure.

As seen in FIG. 2 the present invention contemplates a pair of diametrically opposed inlets 30, 32 at the wide end of the vortex forming chamber C. The inlets 30, 32 direct the high pressure driver fluid tangentially into the wide end of the chamber C at substantially equal angular velocities. The use of diametrically opposed inlets reduces the likelihood of separation bubbles forming along the conical surface 22 of the diffuser and propagating outwardly to the diffuser outlet, a condition which would allow ambient pressure from the outlet to communicate with the throat. This would ultimately destroy the low pressure in the vortex. In the past it has been necessary to skew the position of the diffuser member 20 in order to avoid the damaging effect of separation bubbles which propogate out to the diffuser outlet. The use of diametrically opposed primary fluid inlets eliminates formation and/or propogation of separation bubbles, thereby enhancing maintenance of the vortex flow.

Further according to the present invention a secondary flow deflector 40 is provided. A longitudinally extending member 42 is disposed along the longitudinal axis 14. The member 42 extends through the secondary fluid inlet 24 and into the vortex forming chamber C. The deflector 40 is formed at the end of member 42 and includes a conical surface 46 diverging outwardly from the longitudinal axis 14. The diverging conical surface 46 extends toward, but remains radially inward of, the venturi throat T. The axial position of the deflector 40 can be varied by adjusting the postion of the member 42 (by suitable motive means, not shown).

The deflector 40 causes secondary fluid S sprialing through the secondary fluid inlet 24 to rotate along a path of increased radius as it is drawn into the low pressure region of the vortex. This is believed to enhance the mixing action of the primary driver fluid and the secondary fluid. Such enhanced mixing action improves pumping efficiency.

Where the driver fluid is incompressible fluid such as nitrogen, the present invention further contemplates a specially formed vortex forming chamber C which is shown in full lines in FIG. 1. The vortex forming chamber C includes a conical surface 50 which converges from the wide end 16 of the funnel shaped chamber and extends to the mouth of the secondary fluid inlet 24. The surface 50 preferably converges at an angle $\phi$ of 74°, as seen in FIG. 1.

Further, as shown in FIGS. 1 and 2 the specially formed vortex forming chamber C further includes a pair of blocks 52, each associated with a respect one of the primary driver fluid inlets 30, 32. Each block 52 includes an axially extending wall surface 54. The wall surface 54 of each block decreases in radius from a first end 53 adjacent one fluid inlet to a second end 55 disposed radially inward of the diametrically opposed inlet. Each wall surface 54 guides the driver fluid from one inlet along the conical surface 50 on a path of decreasing radius to a position disposed radially inwardly of the diametrically opposite fluid inlet. Thus, the driver fluid from each inlet is guided along a path which brings it forward and radially inward of the diametrically opposite driver fluid inlet. Again, this feature has been found to improve the pumping characteristics of the ejector when a compressible drive fluid is used.

When an imcompressible fluid such as water is used as the primary driver fluid the structure of the ejector would be similar to FIG. 1, but with the conical surface 50 replaced by a surface perpendicular to the longitudinal axis. Also, no blocks such as 52 are used.

The operating characteristics of the ejector will depend upon factors such as the ratio of the inlet diameter to the throat diameter; the size of the primary driver fluid inlet openings; the size of the secondary fluid inlet opening relative to the throat diameter; the base gap (i.e., the distance between diverging surfaces 12″ and 22 of the diffuser D; the compressibility of the primary driver fluid, and the inlet velocity and mass flow rate of the primary driver fluid. It has been found that pressures as low as 15 torr can be generated by an ejector with water as a driver fluid and having the following characteristics; an inlet to throat diameter ratio of 5.54; a throat having a diameter of 1.00 inches; a pair of driver fluid inlet openings each having a diameter of 0.50 inches; a secondary fluid inlet opening having a diameter of 0.73 inches; a base gap of 0.085 inches; a driver fluid inlet velocity of about 335 feet/sec; and a primary mass flow rate of about 0.10 lbm/sec.

It has been found that pressures as low as 21 torr can be generated with nitrogen as a driver fluid and having the following operating characteristics; and inlet to throat diameter ratio of 3.51; a throat diameter of 1.58 inches; a pair of driver fluid inlet openings each having a diameter of 0.05 inches; a secondary fluid inlet opening of 0.78 inches; a base gap of 0.100 inches; an inlet primary driver fluid velocity of about 480 feet/sec; and a mass flow rate of about 0.17 lbm/sec.

Of course, the specific operating characteristics may be varied. It has been determined that if one considers the secondary fluid inlet diameter as a characteristic length L, an ejector envelope having a throat diameter on the order of 1.4L through 2.5L, and inlet flow diameters on the order of 4L through 8L, can be used to generate extremely low pressures with driver fluid inlet velocities of about 175 through 625 feet/sec (larger inlet velocities being used with smaller inlet to throat ratios) and mass flows of about 0.06 through 0.25 lbm/sec. Such ejectors can be constructed within an axial length, i.e. from inlet to diffuser outlet of approximately three times the characteristic length L. This is believed to be an extremely compact ejector with the capability of pumping extremely low pressure fluids to ambient pressure.

As noted above, an ejector constructed according to the present invention is capable of generating low pressures for pumping neon lazer exhausts. The ejector also has other important applications. For example, an ejector according to the invention can be used in vacuum cleaner type devices for drawing toxic gases out of a dangerous environment. Those of ordinary skill in the art will undoubtedly recognize various additional applications of the principles of this invention in situations where it is necessary or desirable to aspirate or pump liquids or gases.

What is claimed is:

1. An apparatus for pumping fluid, said apparatus comprising a funnel-shaped fluid chamber converging from a wide end to a narrow end, a venturi-like throat having a throat inlet disposed in fluid communication with said narrow end of said funnel-shaped fluid chamber, diametrically opposed first and second fluid inlets for directing a driver fluid tangentially into the wide end of said funnel-shaped chamber, said chamber and said venturi-like throat configured to form the driver fluid into a swirling flow which advances towards a venturi-like throat at an increasing speed in the form of a vortex flow having a low pressure region at the eye thereof, a secondary fluid inlet for communicating the fluid with the low pressure region of the vortex flow formed by said driver fluid so that the fluid is drawn into the chamber by the low pressure at the eye of the vortex flow, for guiding the fluid drawn in said chamber outwardly toward the swirling drive of fluid, whereby the fluid is mixed with the driver fluid to form a swirling flow of mixed fluid which advances through the venturi-like throat, and diffuser configured to guide a swirling flow of fluid from the throat along the path of increasing radius to compress the mixed fluids to the pressure at the diffuser outlet and blocking flow of fluid from the diffuser outler to the throat, said funnel-shaped chamber comprising a funnel-shaped first surface circumscribing a longitudinal axis, said venturi-like throat comprising a second surface contiguous with the first surface and forming a venturi-like passage circumscribing said longitudinal axis, said deflector member including a first diverging surface which circumscribes said longitudinal axis and diverges away from said longitudinal axis, said diverging surface of said deflector terminating in an outer periphery which is closer to said longitudinal axis than the second surface forming the venturi-like throat, said diffuser comprising a second diverging surface contiguous with said second surface and a diffuser member disposed on said longitudinal axis in the path of the swirling flow and including a third diverging surface facing and spaced apart from sad second diverging surface and forming therewith a conical section for guiding the swirling flow of fluid from the outlet of the throat along a path of increasing radius to compress the mixed fluids and blocking flow of fluid from the outlet of the diffuser to the throat.

2. An apparatus as defined in claim 1 including means for adjusting the axial position of said deflector.

3. The apparatus of claim 1 further including a conical surface circumscribing said longitudinal axis and converging from the wide end of the funnel shaped fluid chamber to the mouth of the secondary fluid inlet, and wall means for guiding fluid introduced at each of said first and second fluid inlets along said conical surface on a path of decreasing radius and directing the driver fluid forwardly of the diametrically opposed other inlet to enhance the mixing of the fluids from both inlets when the driver fluid is a compressible fluid.

4. The apparatus as defined in claim 3 wherein said conical surface converges toward said longitudinal axis at an angle of 74°.

5. An apparatus for using a compressible driver fluid for pumping a secondary fluid, said apparatus comprising a funnel shaped fluid chamber converging from a wide end to a narrow end, a venturi-like throat having a throat inlet disposed in fluid communication with said narrow end of said funnel shaped chamber, a first fluid inlet for directing the compressible driver fluid tangentially into the wide end of said funnel shaped chamber, a second fluid inlet disposed diametrically opposite to said first fluid inlet for directing the compressible driver fluid tangentially into the wide end of the funnel shaped chamber at the same angular velocity as driver fluid is introduced into said funnel shaped chamber by said first inlet, a secondary fluid inlet communicating with said funnel shaped chamber, a conical surface converging from the wide end of the funnel shaped chamber to the mouth of said secondary fluid inlet, and wall means for guiding the compressible driver fluid introduced at each of said first and second fluid inlets along said conical converging member and radially on a path of decreasing radius and directing the driver fluid forwardly of the diametrically opposed other inlet, said chamber, said conical surface and said throat configured to form the compressible driver fluid into a swirling vortex flow which advances toward said throat along a decreasing radius and forms a low pressure region therein, said secondary fluid inlet means disposed in the low pressure region of the swirling vortex flow formed by said driver fluid so that the secondary fluid is drawn into said chamber by the swirling vortex flow, a deflector disposed in said funnel shaped chamber for guiding the secondary fluid outwardly toward said throat, whereby the secondary fluid is mixed with compressible driver fluid to form a swirling flow of mixed fluid which advances through the venturi-like throat, a diffuser configured to guide a swirling flow of mixed fluid from the outlet of the throat along a path of increasing radius to compress the mixed fluids to ambient pressure and blocking flow of fluid at ambient pressure from the outlet of the diffuser to the throat.

* * * * *